US007597413B2

(12) United States Patent
Fitz

(10) Patent No.: US 7,597,413 B2
(45) Date of Patent: Oct. 6, 2009

(54) EXTENSION GUIDE FITTING FOR DRAWERS

(75) Inventor: Helmut Fitz, Lustenau (AT)

(73) Assignee: Julius Blum Gesellschaft m.b.H, Höchst (AT)

( * ) Notice: Subject to any disclaimer, the term of this patent is extended or adjusted under 35 U.S.C. 154(b) by 1240 days.

(21) Appl. No.: 10/829,240

(22) Filed: Apr. 22, 2004

(65) Prior Publication Data

US 2004/0212284 A1 Oct. 28, 2004

(30) Foreign Application Priority Data

Apr. 23, 2003 (DE) ..... 203 06 212 U

(51) Int. Cl.
*A47B 88/14* (2006.01)

(52) U.S. Cl. ..... 312/334.15; 312/334.14; 312/334.6; 312/334.39

(58) Field of Classification Search ..... 312/334.1, 312/334.5, 334.6, 334.7, 334.8, 334.12, 334.13, 312/334.14, 334.15, 334.16, 334.18, 334.19, 312/334.21, 334.27, 334.31, 334.32, 334.33, 312/334.34, 334.36, 334.37, 334.39, 334.41, 312/334.42, 330.1; 49/420, 425; 384/18, 384/19, 20

See application file for complete search history.

(56) References Cited

U.S. PATENT DOCUMENTS

| | | | | |
|---|---|---|---|---|
| 2,692,802 A | | 10/1954 | Kurtzon et al. | |
| 2,726,915 A | * | 12/1955 | Schuette | 312/334.9 |
| 4,482,066 A | * | 11/1984 | Dykstra | 211/151 |
| 4,633,615 A | * | 1/1987 | Moose | 49/425 |
| 4,952,074 A | * | 8/1990 | Rock | 384/19 |
| 5,090,171 A | * | 2/1992 | Kano et al. | 52/243.1 |
| 6,478,393 B2 | * | 11/2002 | Kim et al. | 312/334.12 |

FOREIGN PATENT DOCUMENTS

| | | |
|---|---|---|
| AT | 397606 B | 5/1994 |
| AT | 0004518 U1 | 8/2001 |
| DE | 27 31 953 A1 | 1/1978 |
| DE | 4328459 A1 | 5/1995 |
| DE | 29616756 U1 | 1/1997 |
| DE | 19718256 A1 | 11/1998 |
| EP | 0523428 A1 | 1/1993 |
| EP | 0820712 A2 | 1/1998 |
| GB | 1 604 811 | 12/1981 |

* cited by examiner

*Primary Examiner*—James O Hansen
(74) *Attorney, Agent, or Firm*—Wenderoth, Lind & Ponack, L.L.P.

(57) ABSTRACT

An extension guide fitting for drawers includes an extension rail at the drawer side, a carrier rail at the furniture body side, and a middle rail which runs between the extension and carrier rails at both sides of the drawer. The load between the rails is transmitted by running rollers which are mounted in separate carriages. Mounted in the front region of the carrier rail are at least two stationary support rollers on which the extension rail runs via a running limb so as to support the extended rail at least in the closed condition of the drawer.

9 Claims, 4 Drawing Sheets

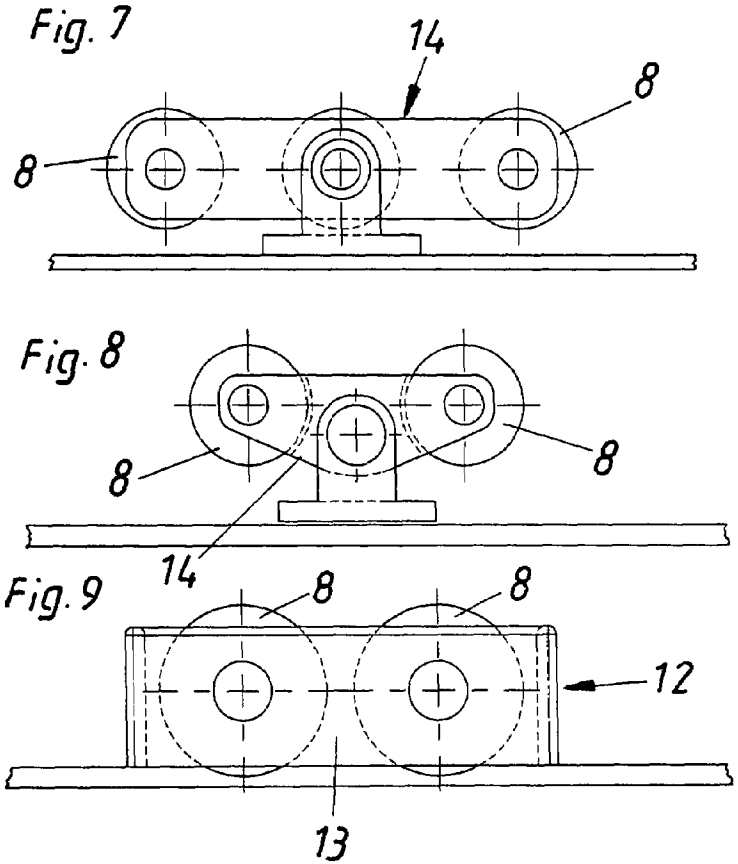
Fig. 7
Fig. 8
Fig. 9
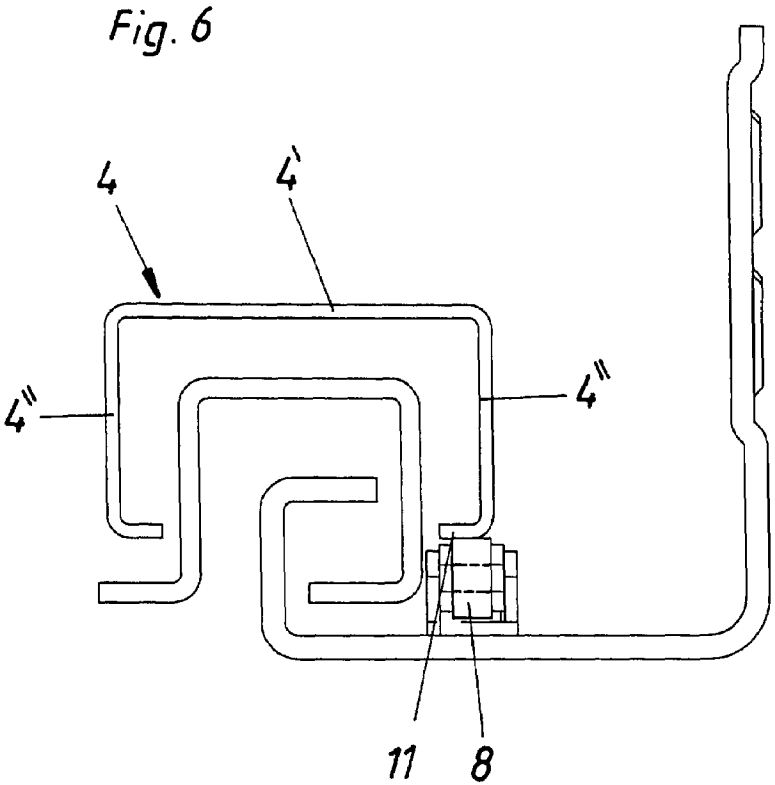
Fig. 6

EXTENSION GUIDE FITTING FOR DRAWERS

BACKGROUND OF THE INVENTION

The invention relates to an extension guide fitting for drawers comprising an extension rail at the drawer side, a carrier rail at the furniture body side, and a middle rail which runs between those two rails at both sides of the drawer. The load between the rails is transmitted by running rollers which are mounted in separate carriages. Mounted in the front region of the carrier rail is a stationary support roller on which the extension rail runs with a running limb and is supported at least in the closed condition of the drawer.

In the case of guide arrangements with running rollers which are mounted in their own carriages, the load-transmitting running elements (namely, the carriages with the rolling bodies) are disposed rather in the center of the guide system. In this connection, the term running rollers is used to denote rolling bodies quite generally, that is to say disc-shaped runner wheels, balls and rollers.

In the case of extension guide fittings with riveted running rollers, the load-transmitting elements are at the largest possible spacing from each other in the closed condition.

Therefore, extension guide fittings with running rollers which are mounted in carriages are more unstable in the closed condition than comparable extension guide fittings with riveted running rollers. That applies in particular in relation to full extension arrangements because they have one rail or running system more than partial extension arrangements.

The instability of the extension guide fitting makes itself felt adversely in the closed condition of the drawer in relation to the fronts of articles of furniture for several reasons. Firstly, the joints between fronts which are disposed in mutually superposed relationship are of different sizes, depending on the respective loading in the drawer or depending on respective production tolerances. Secondly, the fronts do not impinge against the front edge of the body of the article of furniture in parallel relationship, but come to bear against the front edge of the body of the article of furniture upwardly or downwardly, depending on the respective loading on the drawer or depending on respective production tolerances. It has therefore been proposed that, in the case of a full extension arrangement, a so-called run-on portion can be mounted on the drawer rail, the run-on portion running on to the carrier rail at the furniture body side, about 60 mm before reaching the closed position of the extension guide fitting or the drawer. In spite of an inclined run-on surface which is as gentle as possible, the moment at which the run-on portion runs on to the carrier rail can be clearly felt and is therefore perceived as undesirable.

Therefore, Austrian utility model AT 4518 U1 proposed arranging at the front end of each carrier rail a stationary support roller, whereby a gentler running-on movement of the drawer was achieved. That structure, however, did not prove worthwhile in relation to very heavy drawers.

SUMMARY OF THE INVENTION

Therefore the object of the invention is to provide improved heightwise positioning for the front region of the drawer.

The object according to the invention is attained in that mounted in the front region of the carrier rail are at least two support rollers at which the extension rail runs with its running limb and is supported at least in the closed condition of the drawer.

Arranging a plurality of support rollers at the front ends of the carrier rails not only permits a greater loading to be carried, but it also protects and looks after the coating on the extension rails and provides for smoother movement of the drawer.

The term stationary is to be interpreted as meaning that the support rollers are not displaceable in relation to the carrier rail (unlike the running rollers in the carriages).

BRIEF DESCRIPTION OF THE DRAWINGS

Embodiments of the invention are described hereinafter with reference to the Figures of the accompanying drawings.

FIG. 6 shows an end view of the extension guide fitting according to the invention for the drawer, and FIGS. 7 to 9 show side views of the support rollers and the mounting thereof.

DETAILED DESCRIPTION OF THE INVENTION

Figure 1:
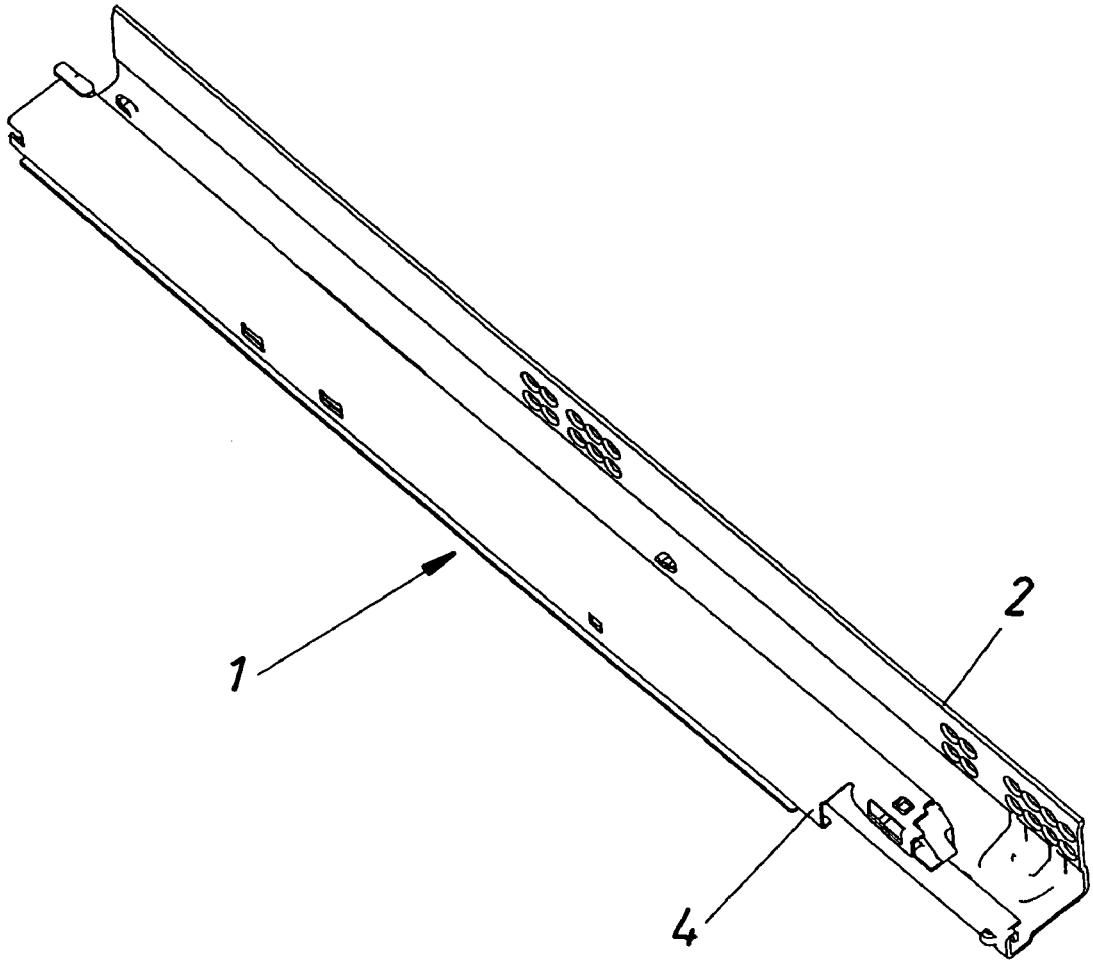
FIG. 1 shows a perspective view of an extension guide fitting according to the invention.
Figure 2:
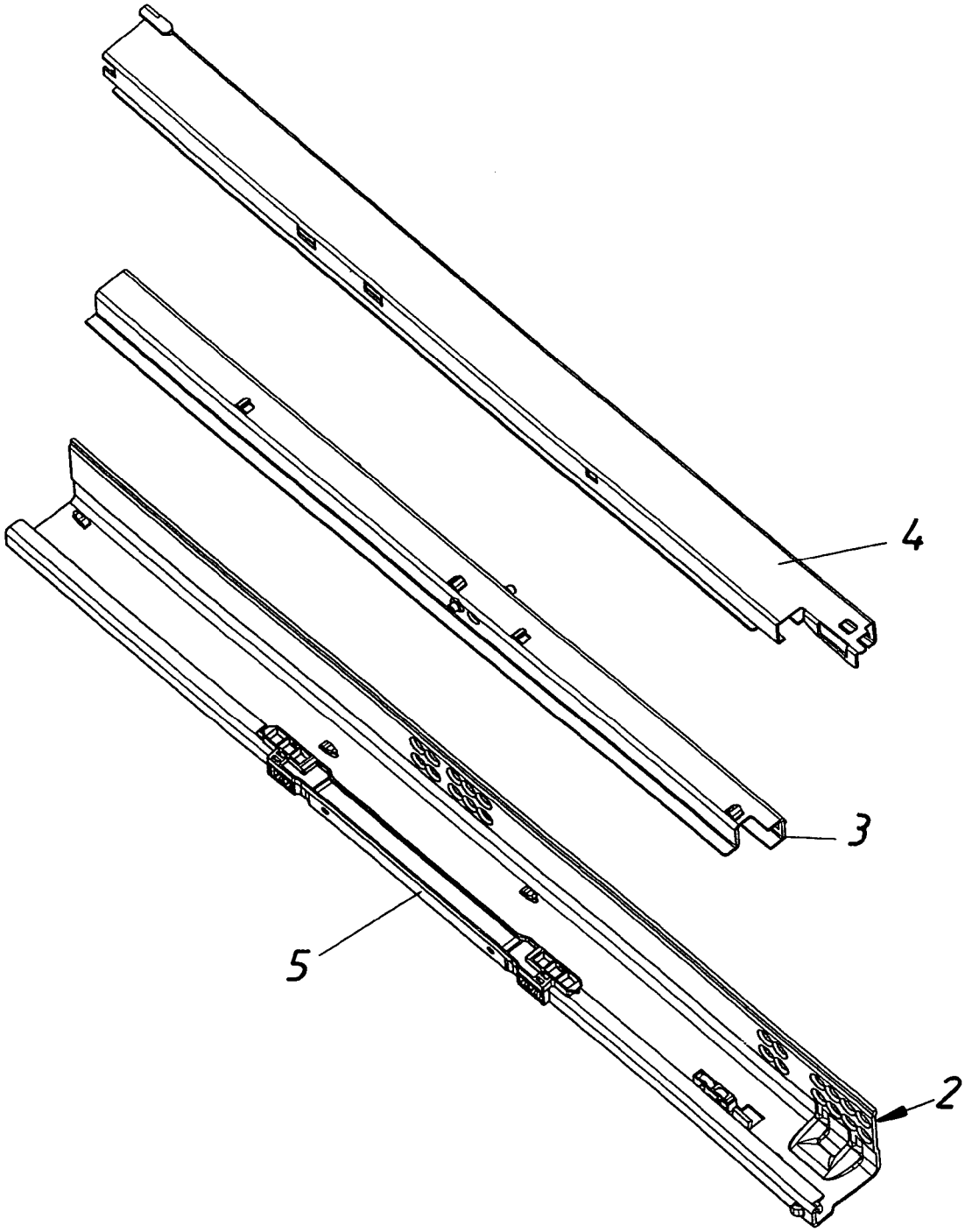
FIG. 2 shows an exploded perspective view of an extension guide fitting according to the invention.
Figure 3:
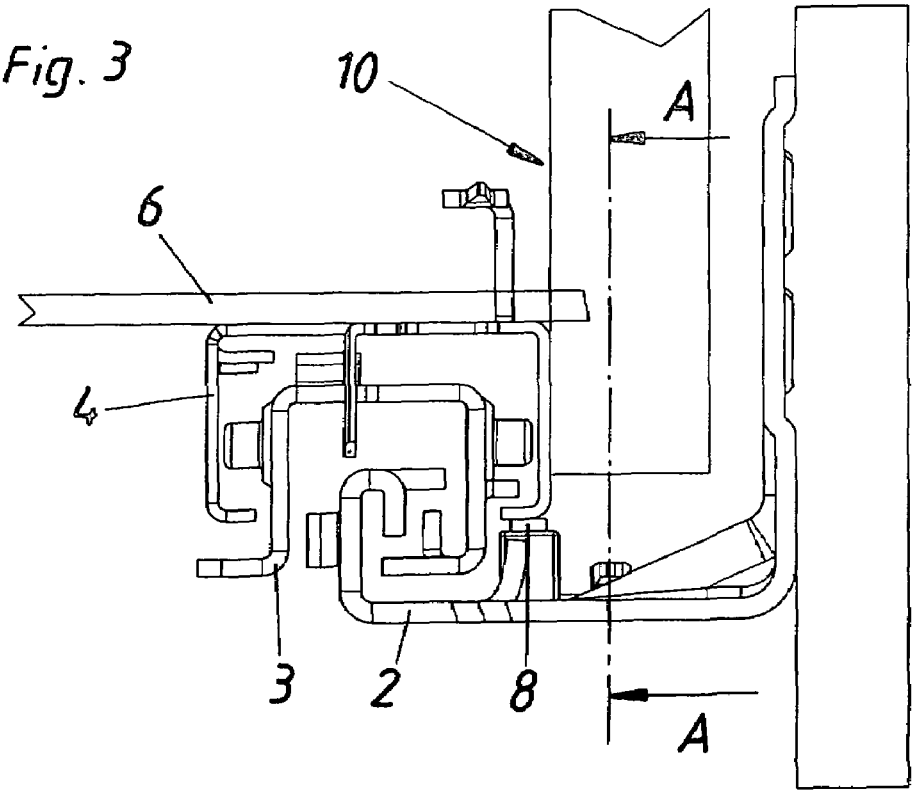
FIG. 3 shows an end view of the extension guide fitting according to the invention with parts of the drawer.

The extension guide fitting 1 according to the invention has a carrier rail 2 which is secured to a side wall of an article of furniture, an extension rail 4 which is secured to the drawer 10 and a middle rail 3 which runs between the two rails 2, 4.

Provided between the carrier rail 2 and the middle rail 3 is a carriage 5 carrying running rollers. At least one carriage 5 with running rollers is also disposed between the middle rail 3 and the extension rail 4.

As, in the closed condition of the drawer 10, the carriages 5 are located substantially in the middle of the guide system, instability of the drawer 10 could not be avoided in the case of a conventional extension guide fitting.

In accordance with the invention, provided in the front region of the carrier rail 2 are at least two support rollers 8, on which the extension rail 4 runs via a running limb 11. The support rollers 8 are arranged one behind the other in the direction of displacement of the drawer 10. The extension rail 4 has an inverted U-shaped profile, with a central limb 4' and two side limbs 4", and the running limb 11 is angled (extends) directly from a side limb 4" towards the interior of the rail profile.

In the illustrated embodiment, the extension rail 4 is arranged directly beneath the drawer bottom 6.

Figure 4:
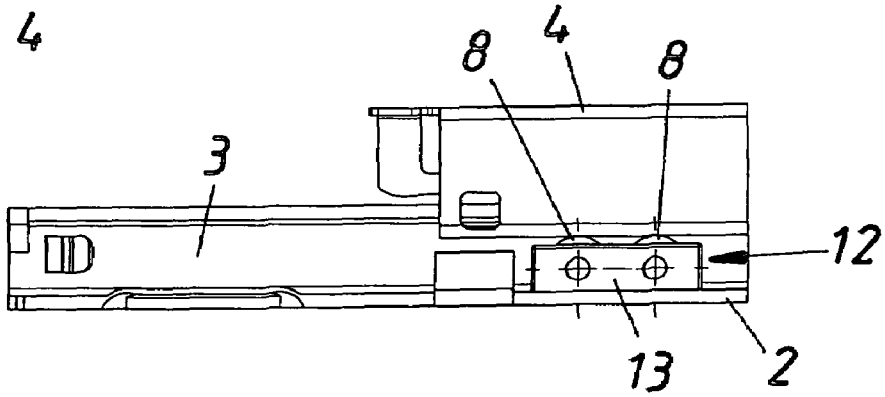
FIG. 4 shows a view of the front end of the extension guide fitting in the direction of the arrows A-A in FIG. 3 when the drawer is closed.
Figure 5:
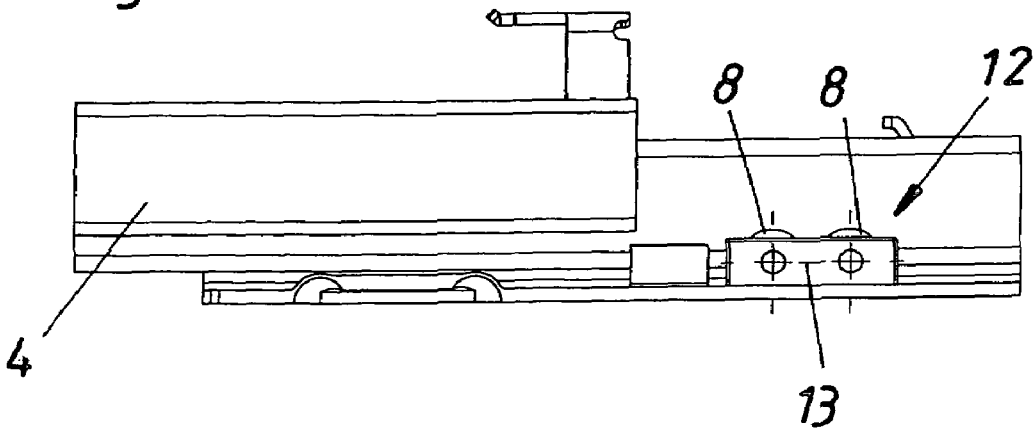
FIG. 5 shows the same view as in FIG. 4 when the drawer is fully extended.

In the embodiment shown in FIGS. 4 and 5, each support roller 8 is mounted in a block 12 which is fitted displaceably on the carrier rail 2. In that way, it is possible to adjust both the spacing of the running roller 8 from the front edge of the carrier rail 2 and also the height of the support roller 8. The block 12 is formed by two plates 13.

In the embodiment shown in FIGS. 7 and 8, two support rollers 8 are mounted on a rocker member 14 (i.e., a tiltable or pivotable member). In the embodiment of FIG. 7, a third support roller 8 is mounted on the shaft of the rocker member 14.

The invention claimed is:

1. An extension guide fitting for a drawer, comprising:

an extension rail to be attached to a drawer;

a carrier rail to be attached to a furniture body;

a middle rail arranged to run between said extension rail and said carrier rail;

carriages each having running rollers mounted therein for transmitting a load between said extension rail, said middle rail, and said carrier rail;

a rocker member mounted at a front portion of said carrier rail; and stationary support rollers mounted in said rocker member, said rocker member and said stationary support rollers being arranged so that said extension rail runs on said stationary support rollers and is supported by said stationary support rollers at least when said extension rail is in a closed position.

2. The extension guide fitting of claim 1, wherein said stationary support rollers are arranged laterally adjacent to said middle rail.

3. The extension guide fitting of claim 1, wherein said stationary support rollers are arranged so that a first one of said stationary support rollers is located behind a second one of said stationary support rollers with respect to a direction of displacement of the drawer.

4. The extension guide fitting of claim 1, wherein said rocker member includes common plates between which said stationary support rollers are mounted.

5. The extension guide fitting of claim 1, wherein said stationary support rollers comprise three stationary support rollers mounted in said rocker member and arranged so that a first one of said three stationary support rollers is located behind a second one of said three stationary support rollers with respect to a direction of displacement of the drawer, and so that said second one of said three stationary support rollers is located behind a third one of said three stationary support rollers with respect to the direction of displacement of the drawer.

6. The extension guide fitting of claim 5, wherein said first support roller and said third support roller are mounted on support plates of said rocker member, and said second support roller is mounted at a central location on a shaft of said rocker member.

7. The extension guide fitting of claim 1, wherein said extension rail has a running limb for contacting and being supported by said stationary support rollers mounted in said rocker member.

8. The extension guide fitting of claim 7, wherein said running limb extends from a side limb of said extension rail so as to project toward an inside of said extension rail.

9. A furniture piece comprising:

a drawer;

a furniture body in which said drawer is fitted;

a first extension guide fitting including:

a first extension rail attached to a first side of said drawer;

a first carrier rail attached to a first side of said furniture body;

a first middle rail arranged to run between said first extension rail and said first carrier rail;

first carriages each having running rollers mounted therein for transmitting a load between said first extension rail, said first middle rail, and said first carrier rail;

a first rocker member mounted at a front portion of said first carrier rail; and first stationary support rollers mounted in said first rocker member, said first rocker member and said first stationary support rollers being arranged so that said first extension rail runs on said first stationary support rollers and is supported by said first stationary support rollers at least when said drawer is in a closed position; and a second extension guide fitting including:

a second extension rail attached to a second side of said drawer;

a second carrier rail attached to a second side of said furniture body;

a second middle rail arranged to run between said second extension rail and said second carrier rail;

second carriages each having running rollers mounted therein for transmitting a load between said second extension rail, said second middle rail, and said second carrier rail;

a second rocker member mounted at a front portion of said second carrier rail; and second stationary support rollers mounted in said second rocker member, said second rocker member and said second stationary support rollers being arranged so that said second extension rail runs on said second stationary support rollers and is supported by said second stationary support rollers at least when said drawer is in a closed position.

* * * * *